US007816596B2

(12) United States Patent
Böttger

(10) Patent No.: US 7,816,596 B2
(45) Date of Patent: Oct. 19, 2010

(54) CAJON WITH FREELY VIBRATING CORNERS

(75) Inventor: Oliver Böttger, Kiel (DE)

(73) Assignee: Roland Meinl Musikinstrumente GmbH & Co. KG, Gutenstetten (DE)

( * ) Notice: Subject to any disclaimer, the term of this patent is extended or adjusted under 35 U.S.C. 154(b) by 0 days.

(21) Appl. No.: 12/340,004

(22) Filed: Dec. 19, 2008

(65) Prior Publication Data

US 2009/0158914 A1 Jun. 25, 2009

(30) Foreign Application Priority Data

Dec. 21, 2007 (DE) ..... 20 2007 017 918 U

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS 5,385,075 A * 1/1995 Carnes et al. ..... 84/411 R
7,482,522 B2 * 1/2009 Wening ..... 84/415
7,485,790 B2 * 2/2009 Payerl ..... 84/411 R
7,601,901 B2 * 10/2009 Payerl ..... 84/411 R
7,692,083 B2 * 4/2010 Aspland ..... 84/415
2008/0034944 A1 * 2/2008 Aspland ..... 84/415
2008/0078279 A1 * 4/2008 Belli ..... 84/411 R

FOREIGN PATENT DOCUMENTS

DE 202007000686 U1 * 6/2007
DE 10 2007 032 204 * 7/2007
DE 202007010655 U1 * 11/2007
DE 202009003513 U1 * 6/2009

OTHER PUBLICATIONS

Kotz Tone, The Kotz Tone Cajon, Latin Beat Magazine, Nov. 2001, viewed Oct. 22, 2009 at http://findarticles.com/p/articles/mi_m0FXV/is_9_11/ai_80902502/.*
German Ocana, "How to Build Flamenco Cajon with Plywood," .COPYRGT. 2004, http://www.ocanartesania.com/V2/pdf/articulos/building.sub.--cajon.pdf viewed Aug. 10, 2008.*
Cajon Guide © 2007, viewed Oct. 22, 2009 at http://cajonguide.com/.*

* cited by examiner

*Primary Examiner*—Jeffrey Donels
*Assistant Examiner*—Robert W Horn
(74) *Attorney, Agent, or Firm*—Henry M. Feiereisen; Ursula B. Day

(57) ABSTRACT

A cajón includes a housing with sides forming at least one strike plate. One or several corners of a strike plate protrude beyond a recess of the housing for producing additional sound effects, such as rim-shots and rim-clicks.

18 Claims, 7 Drawing Sheets

CAJON WITH FREELY VIBRATING CORNERS

CROSS-REFERENCES TO RELATED APPLICATIONS

This application claims the priority of German Patent Application, Serial No. 20 2007 017 918.9, filed Dec. 21, 2007, pursuant to 35 U.S.C. 119(a)-(d), the content of which is incorporated herein by reference in its entirety as if fully set forth herein.

BACKGROUND OF THE INVENTION

The present invention relates to a cajón with a cube-shaped housing preferably made of wood.

Nothing in the following discussion of the state of the art is to be construed as an admission of prior art.

"Cajón" is a generic term for percussion instruments which originated in South America and whose function is originally based on an unintended use of discarded crates and boxes. They therefore have different shapes and sizes and handle widely differently.

The most common form of the cajón is a hollow cube-shaped box on which the player playing the instrument is seated. The side faces then operate as strike plates, wherein one of the faces frequently includes a snare mechanism and is typically designated as the front wall. A sound hole is frequently placed in one of the other side faces.

It would therefore be desirable and advantageous to provide an improved cajón to obviate prior art shortcomings and to enhance the functionality of a cajón.

SUMMARY OF THE INVENTION

According to one aspect of the present invention, a cajón includes a housing having sides, with at least one of the sides serving as a strike plate, wherein at least one corner of the strike plate projects beyond a recess of the housing.

According to another feature of the present invention, the at least one corner may be attached to the strike plate as a freely vibrating corner. The corner may be adapted to be a block. The strike plate may be attached to a support rail and reinforced by a block to increase a mass of the corner. The corner that vibrates via the support rail may include a point-shaped rear elevation. The cajón body may have a closed recess in the adjacent rear section, beyond which the corner of the strike plate protrudes in form of a tongue.

The corner and the support rail form a sound-producing part which may be made of wood, metal and/or plastic. The sound-producing part may also include a sound cord an/or a rattle assembly and may be interchangeable.

According to another feature of the present invention, the cajón may also include a motion-transmitting device having two ends, for example, a rod or an articulated linkage, wherein one end is attached the corner that vibrates via the support rail, and the other end strikes a sound-producing part disposed inside the housing and not located in immediate vicinity of another corner.

In accordance with the present invention, the tonal characteristics of a cajón can be enhanced with certain tonal properties of a snare drum: the so-called rim shots and rim clicks. Rim shots are typically produced by moving the drum stick in a certain way, whereby the upper drum ring and the drumhead are struck simultaneously. Rim clicks are produced by placing one drumstick onto the drumhead, whereas the other end extends beyond the drum rim and is tipped onto the drum rim.

With the structure of the invention and corresponding play methods, sounds can be produced which resemble those of temple or wood blocks. Generating the played sound in addition to the tonal characteristic itself becomes technically simple. In particular, playing the instrument becomes very intuitive for drummers, because the arrangement of the specific effects takes into consideration the feel of playing a snare drum, so that the effects can be generated without requiring specific ability and handling of hand percussion instruments.

Depending on the position of the hand during a strike, attacks approaching those of a rim shot effect can be added without increasing the strike force. Moreover, separate distinct sounds otherwise produced by so-called small percussion instruments are possible when the instrument is played in a proper manner. The characteristically simple box shape is retained in spite of the enhanced sound generation.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
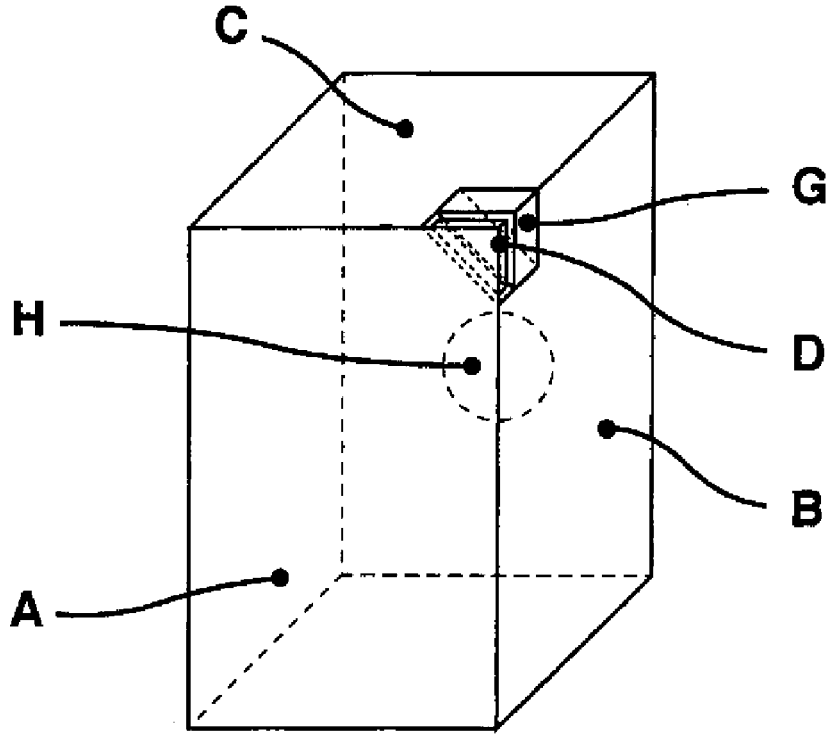
FIG. 1 shows schematically a cajón of a typical design and position, including the position of a corner forming a sound element according to the invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a general shape of a cajón configured as a hollow cube on which the player is seated during play. The cajón has a housing or body having faces which define lateral boundaries to form strike plates (A). One of the strike plates oftentimes has a snare mechanism and is typically regarded as the front wall (A). Another one of the other side faces (B) frequently includes a sound hole (H).

Figure 2:
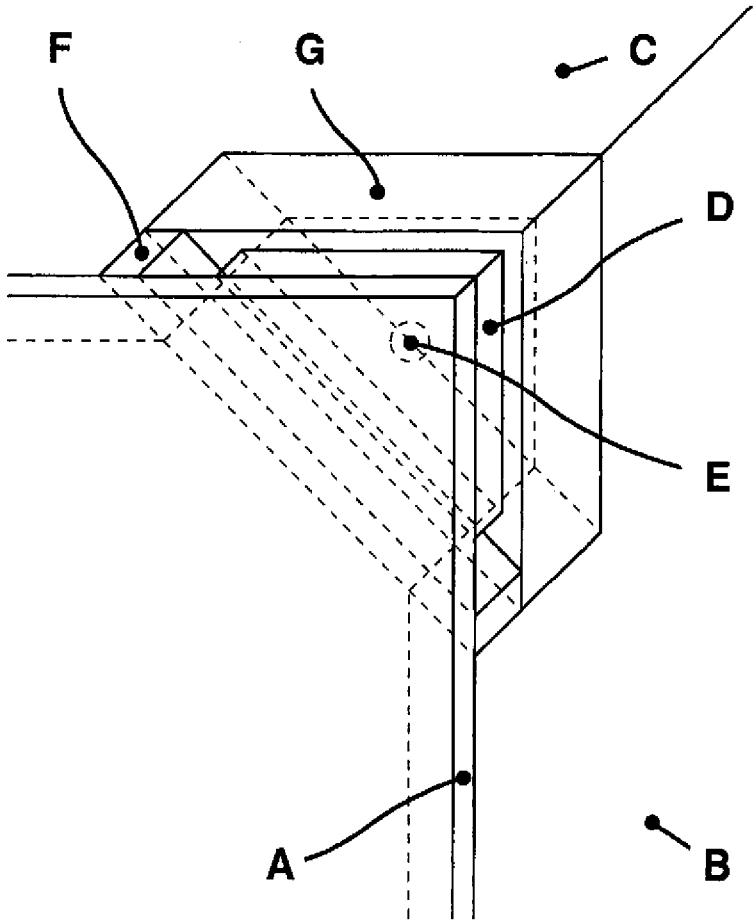
FIG. 2 shows a corner according to the invention in a perspective view.
Figure 3:
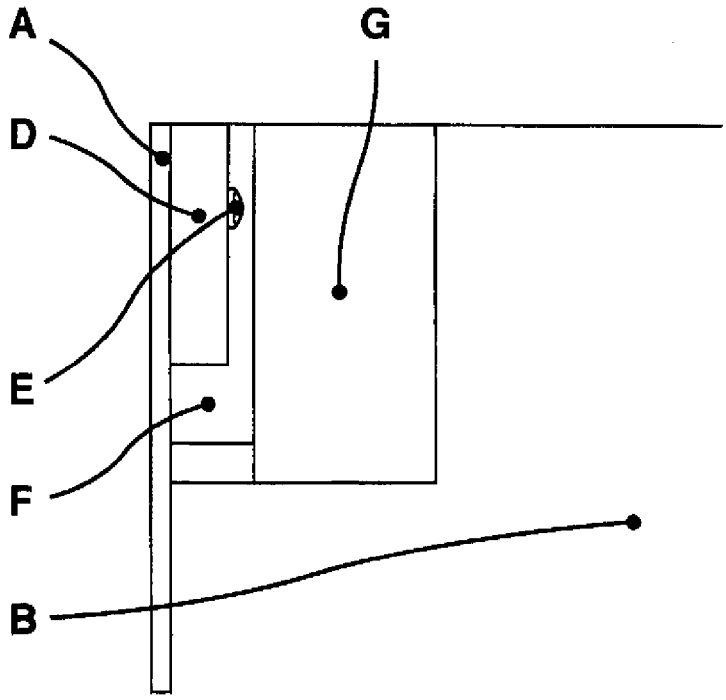
FIG. 3 shows a corner according to the invention in a side view.

FIGS. 2 and 3 show shows perspective and side views of a freely vibrating corner configured in accordance with the invention. The freely vibrating corner is reinforced and weighted down with a block (D). This approach contributes to the dynamics of the produced effect and also facilitates its generation. The corners can also be shaped to enhance the comfort for the player.

A rail (F) connected with the body forms the support for the corner of the strike plate, which is then able to oscillate until it strikes a sound element (G) attached in the rear, which can be made of wood, plastic or metal, and which is preferably integrated in the structure of the body. Advantageously, the freely vibrating corner can have a rear point-shaped bump (E), the position of which is significant for the sound effect. Because in some embodiments, sound is produced through cooperation between the rail (F) and the sound element (G), the combination of the rail (F) and the sound element (G) will also be referred to as sound-producing element.

Figure 5:
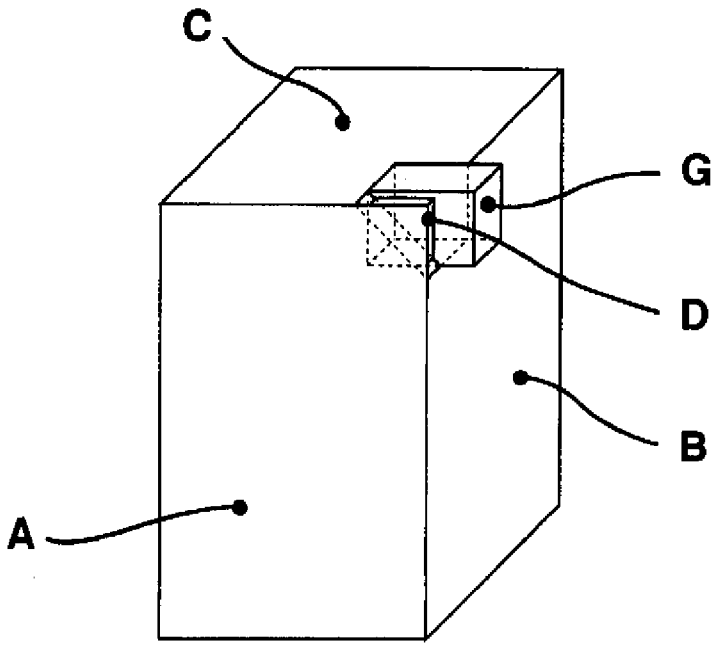
FIG. 5 is a schematic diagram of a yet another embodiment of a sound element according to the invention.
Figure 6:
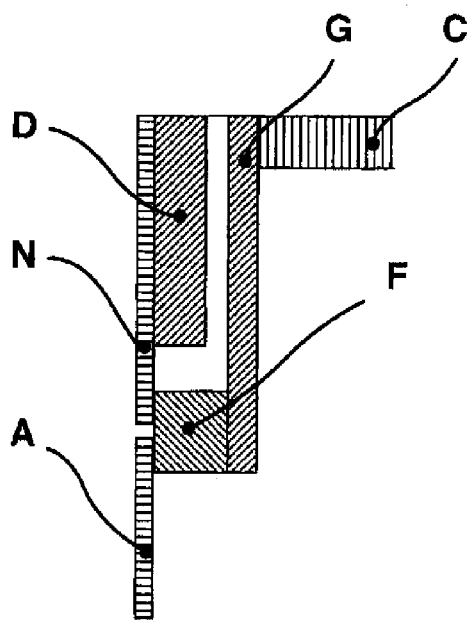
FIG. 6 is a cross-sectional view of another embodiment of a corner forming a sound element according to the invention.

The sound element (G) can be implemented in various ways and may, for example, be made of a simple platelet (FIG. 6). FIGS. 1 to 5 illustrate solid block-shaped elements. An advantageous modification of the sound element (G) is a hollow body, which is either completely enclosed or open on one side, or has openings to the inside and/or outside.

Figure 4:
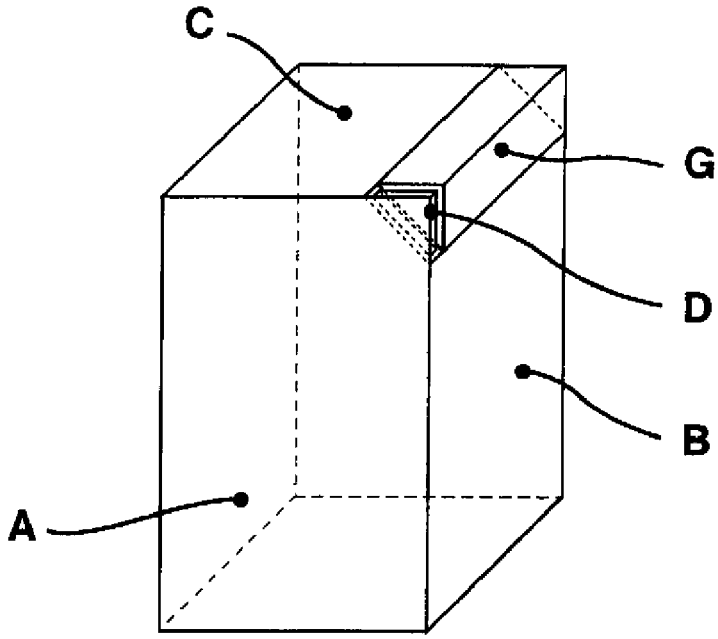
FIG. 4 shows a schematic diagram of another embodiment of a sound element according to the invention.

Shape, size, and position of the sound element (G) can vary (examples in FIG. 1, FIG. 4 and FIG. 5). Additional possible embodiments (not shown in the drawings) include e.g. sound elements attached along the entire vertical edge (formed by A and B) or along the front edge of the face (C) forming the seating area. Also possible is an embodiment, wherein a complete sidewall, e.g. the seating area (C), is formed as a sound element (G).

Figure 8:
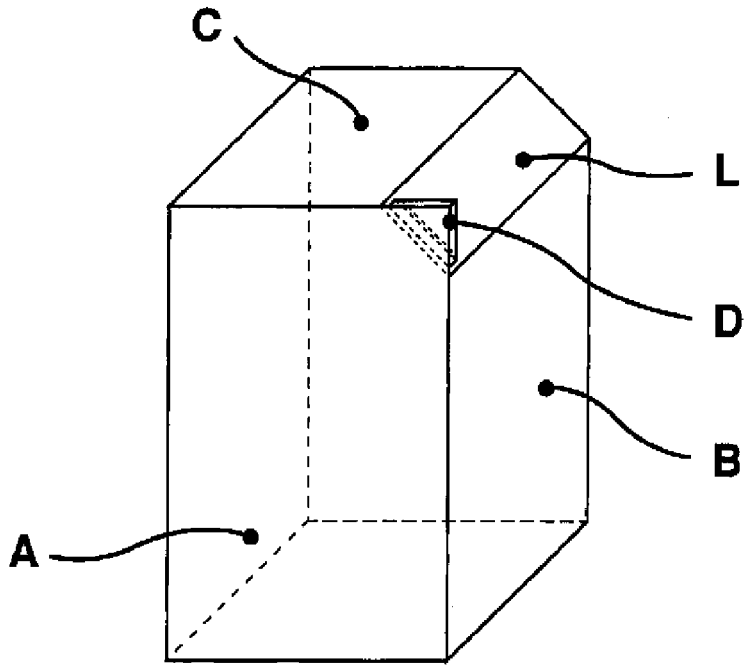
FIG. 8 is a schematic diagram of a strike plate corner according to the invention, with the recess arranged behind the corner and extending in the entire body depth.

One variation of the invention involves the absence of a contact between the freely vibrating corner and the rearward sound element (G) when struck, while a tonal sound is nevertheless produced as a result of the vibration of the corner as simultaneous contact is established with the support rail forming part of the body (F). FIG. 8 shows an embodiment in which the rearward recess extends over the entire depth of the body.

Figure 7:
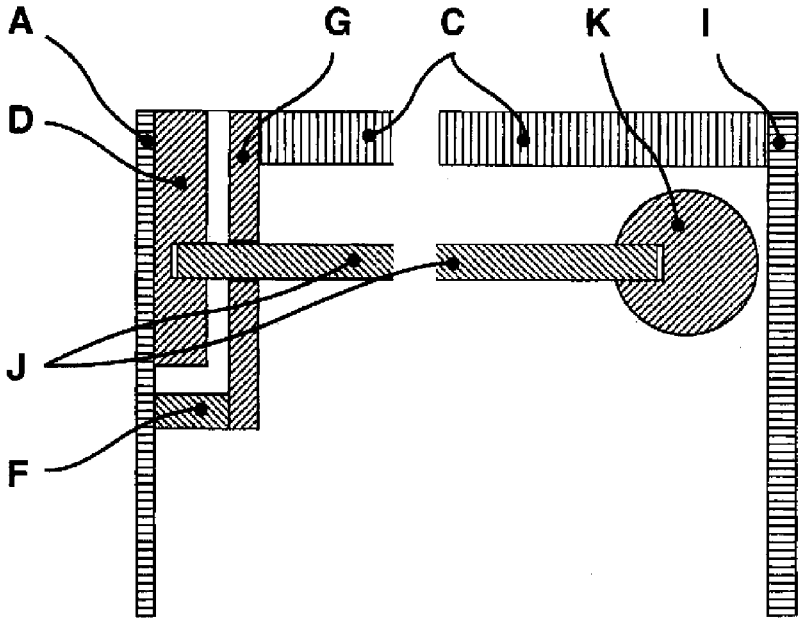
FIG. 7 is a cross-sectional view of yet another embodiment of a corner forming a sound element according to the invention, with the corner connected with a rod extending into the interior of the cajón and producing a sound on the opposite cajón wall.

According to another variation of the invention, a motion-transmitting device is attached on the vibrating corner for striking a sound-producing part which is disposed inside the body and not located in immediate vicinity of the corners. The device includes a rod (FIG. 7) or a linkage having an end which can have a thickened section (K) for amplifying the sound effect.

Figure 9:
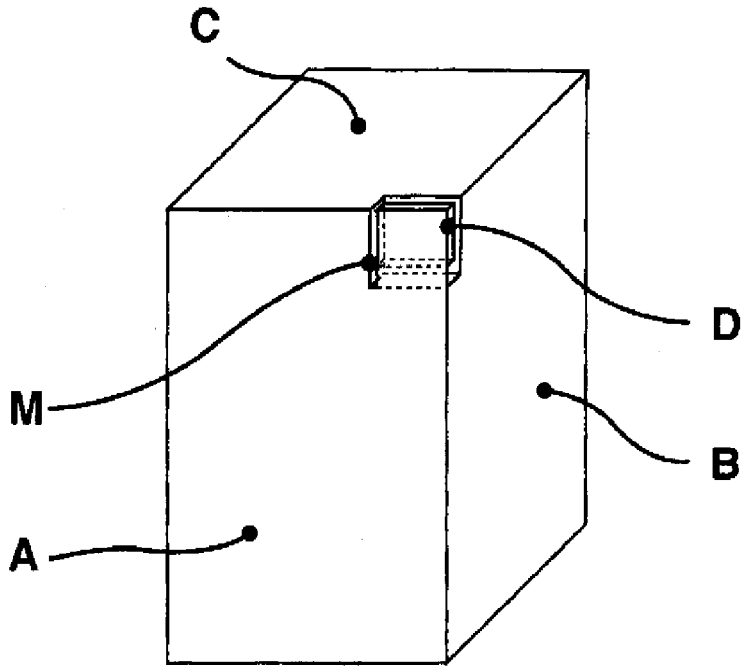
FIG. 9 is a schematic diagram of a modified embodiment of a strike plate corner according to the invention, wherein the strike plate corner is formed as a separate tongue.

A particular embodiment of the invention involves the possibility to construct the corner region of the strike plate as a separate tongue by way of a slotted opening. FIG. 9 shows a variant in which a vertical slot provides an enhanced vibrating capability. Such an opening can also have a different orientation or can have a triangular contour.

Figure 10:
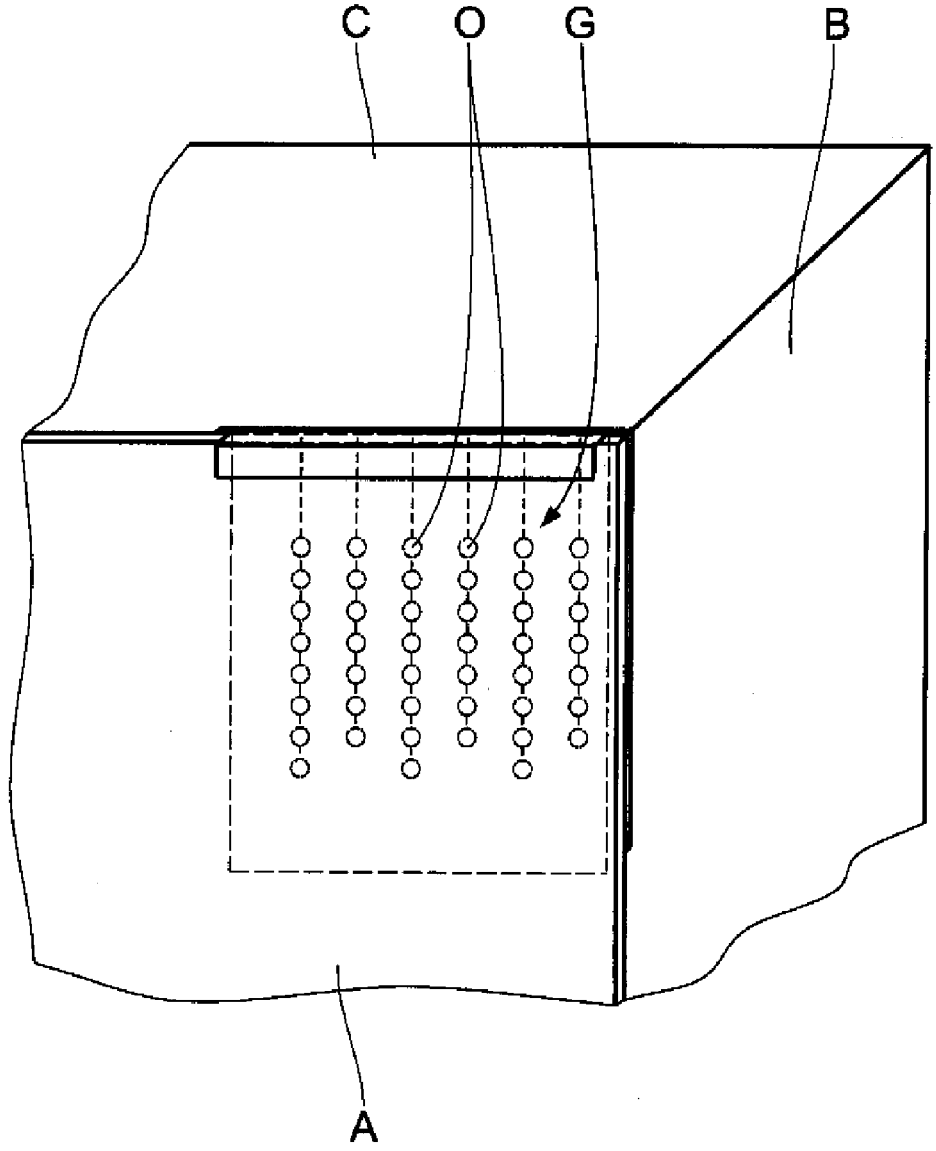
FIG. 10 is a schematic diagram of another embodiment according to the invention, wherein the strike plate corner includes sound cords forming sound elements.

FIG. 10 shows an embodiment in which sound elements (G) indicated by a dotted line are applied in the upper corner regions of the strike plate (A), which are embodied as sound cords (O) with sound beads or differently shaped metal parts suspended from a mounting rail (P). The latter can be hooked, e.g. clipped, between the corner and the actual body.

Figure 11:
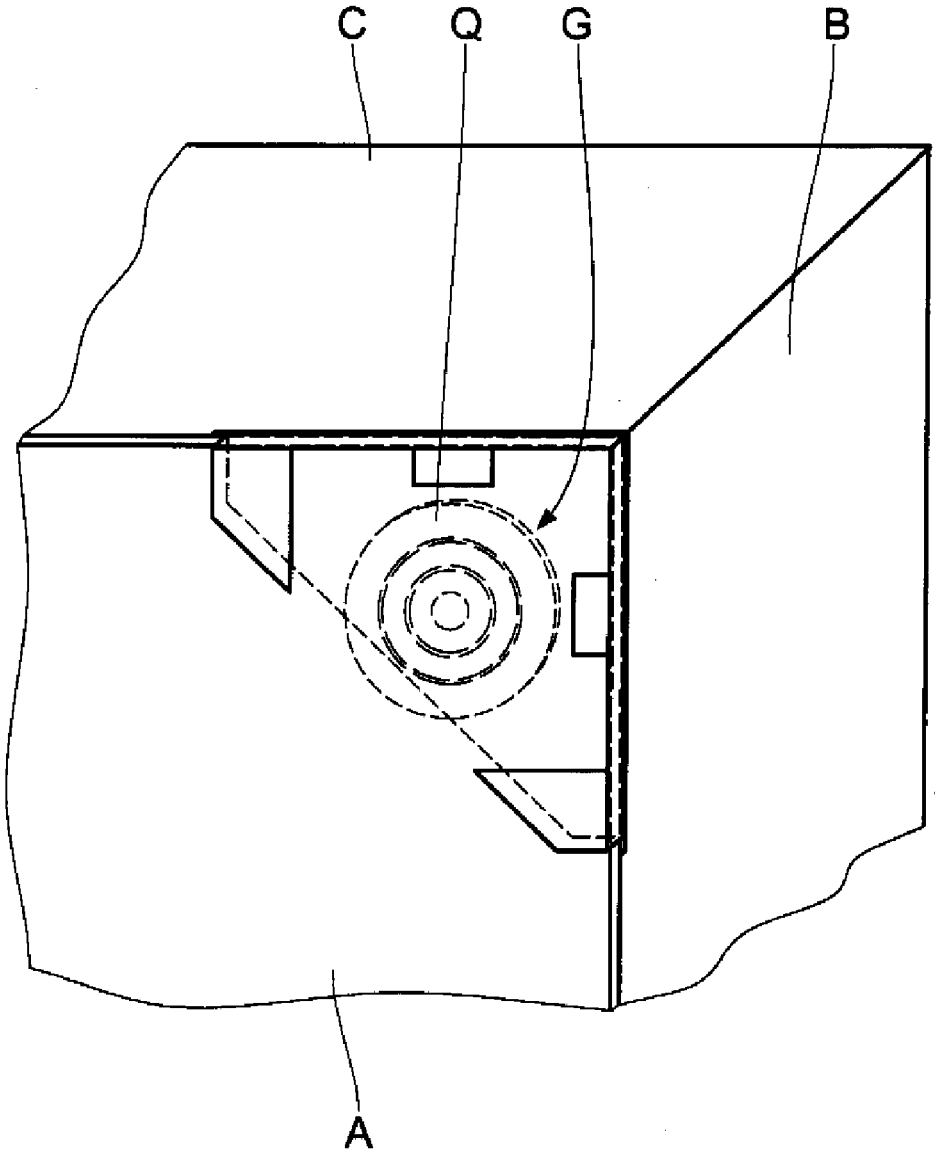
FIG. 11 is a schematic diagram of yet another embodiment, wherein the strike plate corner includes bells forming sound elements.

FIG. 11 shows an embodiment in which a sound element (G) is implemented in form of a rattle assembly (Q) (indicated as dotted line).

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A cajón comprising a housing having sides, with at least one of the sides serving as a strike plate, wherein at least one of the corners of the strike plate projects beyond a recess of the housing.

2. The cajón of claim 1, wherein the at least one corner is attached to the strike plate as a freely vibrating corner.

3. The cajón of claim 2, wherein the at least one corner is adapted to be a block.

4. The cajón of claim 1, wherein the strike plate comprises a slot which provides the corner of the strike plate with a tongue-shaped configuration.

5. A cajón comprising a housing having sides, with at least one of the sides serving as a strike plate, wherein at least one of the corners of the strike plate projects beyond a recess of the housing, and wherein the at least one corner is structurally separated from the strike plate and attached on a support rail in a support plane of the strike plate.

6. The cajón of claim 5, further comprising a block to increase a mass of the corner, said block being attached to the at least one corner which vibrates via the support rail.

7. The cajón of claim 5, wherein the at least one corner that vibrates via a support rail has a point-shaped rear elevation.

8. The cajón of claim 5, wherein the recess is demarcated by a boundary to produce a sound, when the at least one corner is struck and vibrates via the support rail.

9. The cajón of claim 8, wherein the boundary is configured in the form of a stand-alone percussion sound generator for sound optimization.

10. The cajón of claim 8, wherein the at least one corner and the support rail form a sound-producing part which is made of wood, metal or plastic, or a combination thereof.

11. The cajón of claim 10, wherein the sound-producing part further comprises at least one of a sound cord and a rattle assembly.

12. The cajón of claim 10, wherein the sound-producing part forms a structural component of the housing.

13. The cajón of claim 10, wherein the sound-producing part protrudes beyond at least one outer boundary of the housing.

14. The cajón of claim 10, wherein the sound-producing part is interchangeable.

15. A cajón comprising a housing having sides, with at least one of the sides serving as a strike plate, wherein at least one of the corners of the strike plate projects beyond a recess of the housing, further comprising a support rail interposed between the at least one corner and the strike plate, wherein the strike plate is attached to and oscillates via the support rail.

16. The cajón of claim 15, further comprising a motion-transmitting device having two ends, wherein one end is attached to the corner that vibrates via the support rail, and the other end strikes a sound-producing part disposed inside the housing at a distance to the corner.

17. The cajón of claim 16, wherein the motion-transmitting device comprises a rod or an articulated linkage for producing the sound inside the housing.

18. The cajón of claim 16, wherein the other end is configured in the form of a thickened section.

* * * * *